US008848949B2

(12) United States Patent
Akino

(10) Patent No.: US 8,848,949 B2
(45) Date of Patent: Sep. 30, 2014

(54) CONDENSER MICROPHONE UNIT AND CONDENSER MICROPHONE

(75) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 609 days.

(21) Appl. No.: 13/217,617

(22) Filed: Aug. 25, 2011

(65) Prior Publication Data

US 2012/0051575 A1 Mar. 1, 2012

(30) Foreign Application Priority Data

Aug. 26, 2010 (JP) ..... 2010-189626

(51) Int. Cl.
*H04R 25/00* (2006.01)
*H04R 1/04* (2006.01)
*H04R 19/04* (2006.01)

(52) U.S. Cl.
CPC . *H04R 1/04* (2013.01); *H04R 19/04* (2013.01)
USPC ..... 381/174; 381/355; 381/191

(58) Field of Classification Search
CPC ..... H04R 1/04; H04R 19/00; H04R 19/005; H04R 19/01; H04R 19/016; H04R 19/04; B06B 1/0292
USPC ..... 381/113, 355, 356, 357, 360, 369, 174, 381/175, 191; 367/170, 181; 29/25.41, 594
See application file for complete search history.

(56) References Cited

U.S. PATENT DOCUMENTS 4,281,222 A * 7/1981 Nakagawa et al. ..... 381/357
7,620,191 B2 * 11/2009 Tanabe et al. ..... 381/174

FOREIGN PATENT DOCUMENTS

| | | | |
|---|---|---|---|
| GB | 2253117 | A | 8/1992 |
| JP | 61-197800 | U | 12/1986 |
| JP | 11-266499 | A | 9/1999 |
| JP | 2006-166230 | A | 6/2006 |
| JP | 2008-98851 | | 4/2008 |

* cited by examiner

*Primary Examiner* — Huyen D Le
(74) *Attorney, Agent, or Firm* — Whitham Curtis Christofferson & Cook, PC

(57) ABSTRACT

A condenser microphone unit includes a diaphragm; a fixed electrode defining a capacitor together with the diagram; a cylindrical electrode having a first end and a second end, the first end being fitted to the periphery of the fixed electrode; a circuit board in contact with a second end of the cylindrical electrode, the circuit board being electrically connected to the cylindrical electrode; a unit casing accommodating the diaphragm, the fixed electrode, the cylindrical electrode, and the circuit board; and a hollow insulating air chamber provided between the internal peripheral surface of the unit casing and the external peripheral surface of the cylindrical electrode.

4 Claims, 5 Drawing Sheets

CONDENSER MICROPHONE UNIT AND CONDENSER MICROPHONE

BACKGROUND OF THE INVENTION

1. Field of the Invention

The present invention relates to a condenser microphone unit and a condenser microphone including the condenser microphone unit, the condenser microphone unit enhancing the sensitivity and the S/N ratio of the condenser microphone.

2. Related Background Art

Japanese Unexamined Patent Application Publication No. 2008-098851 discloses a condenser microphone that includes a condenser microphone unit having a diaphragm that vibrates in response to sound waves and a fixed electrode (also referred to as "back electrode") which are disposed oppositely with a spacer therebetween to configure a capacitor having a variable capacitance in response to vibration of the diaphragm. Such a condenser microphone unit is composed of built-in components, including the diaphragm and the fixed electrode, accommodated into a unit casing.

FIGS. 4 and 5 are each a cross-sectional view illustrating a typical conventional condenser microphone unit 10. FIG. 4 illustrates a cylindrical insulating washer, whereas FIG. 5 illustrates an insulating washer having an increased internal diameter at its upper end.

The condenser microphone unit 10 includes a unit casing 12 that accommodates a diaphragm 14 held by a diaphragm holder 13, a spacer 15, a fixed electrode 16, an insulating washer 17, a cylindrical electrode 18, and a circuit board 19 on which electric components including an FET 19*a* are mounted, in sequence. The open end 12*a* of the unit casing 12 is bent inward to fix the built-in components in the unit casing 12 to the interior of the unit casing 12 such that the circuit board 19 is urged toward the bottom 12*b* of the unit casing 12.

In the condenser microphone unit 10 having such a configuration, a capacitor is defined by the opposing diaphragm 14 and fixed electrode 16. Vibration of the diaphragm 14 in response to received sound waves leads to variations in the gap between the diaphragm 14 and the fixed electrode 16 and thus the capacitance of the capacitor. The variable capacitance is output as audio signals due to a change in voltage.

The insulating washer 17 ensures insulation between the fixed electrode 16 and the unit casing 12. The insulating washer 17 also fixes the radial positions of the components fitted in the condenser microphone unit 10, thereby preventing eccentricity of the components.

After the open end 12*a* of the unit casing 12 is bent as described above, however, the positions of the built-in components are fixed by the urging force exerted on the circuit board 19, the cylindrical electrode 18, the fixed electrode 16, the spacer 15, the diaphragm 14, the diaphragm holder 13, and the bottom 12*b* of the unit casing 12. Furthermore, the fixed electrode 16 is insulated from the unit casing 12. Thus, the insulating washer 17 becomes unnecessary.

The insulating washer 17 is composed of a resin material, such as polycarbonate or ABS. Although such a resin material generally has an extremely high volume resistivity, the surface resistivity decreases with an increase in humidity in the surrounding air. In the case where the shortest distance along the surface of the insulating washer 17 (creepage distance) between the fixed electrode 16 and the unit casing 12 is short, increased humidity causes a leakage current causing noise on the surface of the insulating washer 17. Insulation by dry air does not cause such a leakage current.

In addition, the diaphragm vibrates in response to a difference between pressures exerted on the front and rear surfaces of the diaphragm in the condenser microphone. As the volume of an air chamber increases in the rear of the diaphragm (on the fixed electrode side), the back pressure generated by vibration of the diaphragm decreases. This facilitates vibration of the diaphragm, thus enhancing the sensitivity and frequency response in bass sound of the condenser microphone. The insulating washer 17, however, which reduces the volume of the air chamber, precludes vibration of the diaphragm, thus lowering the sensitivity and frequency response in bass sound of the condenser microphone. Removing the insulating washer 17 for utilization of the corresponding volume for the air chamber can enhance the sensitivity, S/N ratio, and frequency response in bass sound compared to a condenser microphone unit having the same external shape.

In the case where the cylindrical electrode 18 connecting the fixed electrode 16 and the FET 19*a* and the insulating washer 17 surrounding the cylindrical electrode 18 are concentrically disposed, the condenser microphone unit has stray capacitance (floating capacitance) in proportion to the relative permittivity, i.e., 2 to 3 of the plastic, compared to the case of insulation by air which has a relative permittivity of approximately 1. The stray capacitance lowers the sensitivity of the condenser microphone.

SUMMARY OF THE INVENTION

An object of the present invention is to provide a condenser microphone unit that does not include an insulating washer to prevent generation of a leakage current and increases the volume of an air chamber to prevent an increase in stray capacitance and thus to enhance the sensitivity and S/N ratio. Another object of the present invention is to provide a condenser microphone including the condenser microphone unit.

The present invention provides a condenser microphone unit including a diaphragm; a fixed electrode disposed opposite to the diaphragm with a gap therebetween and defining a capacitor together with the diagram; a cylindrical electrode having a first end and a second end, the first end being fitted to a periphery of the fixed electrode; a circuit board including electronic components mounted thereon and being in contact with the second end of the cylindrical electrode, the circuit board being electrically connected to the cylindrical electrode; a unit casing accommodating the diaphragm, the fixed electrode, the cylindrical electrode, and the circuit board; and a hollow insulating air chamber provided between an internal peripheral surface of the unit casing and an external peripheral surface of the cylindrical electrode. Furthermore, the present invention provides a condenser microphone including the condenser microphone unit in a microphone casing.

The present invention prevents generation of a leakage current by eliminating an insulating washer, increases the volume of an air chamber in the rear of the diaphragm, and reduces stray capacitance, thus enhancing the sensitivity and S/N ratio of the condenser microphone unit and the condenser microphone.

DESCRIPTION OF THE PREFERRED EMBODIMENTS

<Condenser Microphone Unit>

Figure 1:
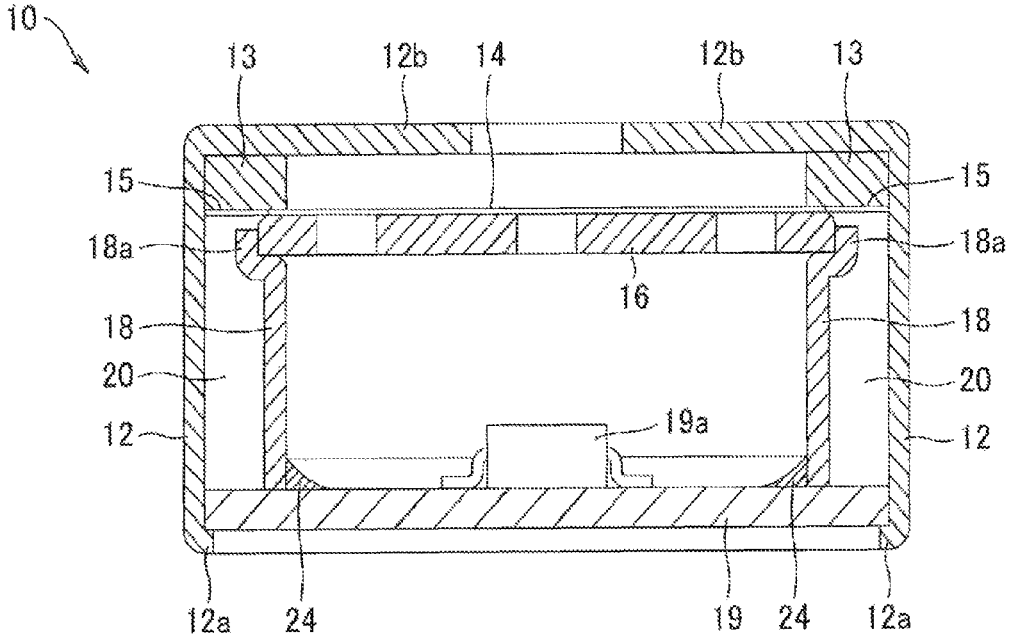
FIG. 1 is a cross-sectional view of a condenser microphone unit according to an embodiment of the present invention.
Figure 2:
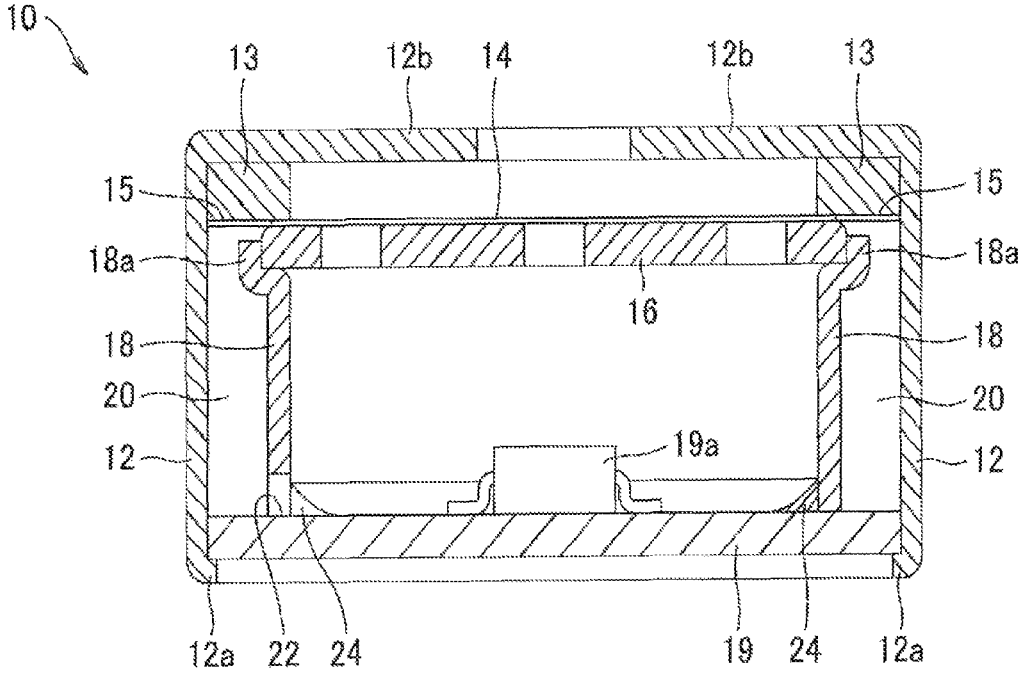
FIG. 2 is a cross-sectional view of a condenser microphone unit according to a modification of the present invention.

Embodiments of a condenser microphone unit according to the present invention are explained below with reference to FIGS. 1 to 3. In FIGS. 1 and 2, components and configurations identical to those of the conventional condenser microphone unit are denoted with identical reference numerals.

With reference to FIG. 1, a condenser microphone unit 10 has a bottomed cylindrical unit casing 12, in which a diaphragm 14 held by a diaphragm holder 13, a spacer 15, a fixed electrode 16, a cylindrical electrode 18, and a circuit board 19 on which electric components including an FET 19*a* are mounted are sequentially fitted.

The front of the unit casing 12 is a portion corresponding to the bottom 12*b*. The bottom 12*b* is provided with a plurality of holes through which sound is introduced into the interior of the unit. The ring diaphragm holder 13 and the diaphragm 14 are disposed proximate to the bottom 12*b* in the unit casing 12, the diaphragm 14 having an external periphery fixed to a side surface of the diaphragm holder 13 with an appropriate tensile force. The diaphragm 14 is composed of a thin resin film, for instance, which vibrates in response to received sound waves.

The fixed electrode 16 is disposed opposite to the diaphragm 14 with the ring spacer 15 therebetween. A gap equal to the thickness of the spacer 15 is provided between the diaphragm 14 and the fixed electrode 16. A thin layer is provided on the opposing surface of at least one of the diaphragm 14 and the fixed electrode 16, the thin layer having an electret element or a semipermanently charged polymer. Thus, a capacitor is defined by the diaphragm 14 and the fixed electrode 16. The diaphragm 14 vibrates in response to sound introduced through the holes in the unit casing 12. Accordingly, the capacitance of the capacitor varies and the variable capacitance is output as audio signals.

The cylindrical electrode 18 is a hollow cylindrical conductive member. The cylindrical electrode 18 in FIG. 1 is provided with a flange step 18*a* having an increased internal diameter at its first upper end. The fixed electrode 16 is fitted to the step 18*a* to be radially positioned and electrically conducted with the cylindrical electrode 18.

A second end of the cylindrical electrode 18 not provided with the step 18*a* is electrically conducted and bonded to the circuit board 19 through cream solder 24. A soldering pattern 21 to which the cream solder 24 is applied on the circuit board 19 has a circular shape as shown in FIG. 3. With the components positioned and fixed in the unit casing 12, the circular soldering pattern 21 is concentric to circular planar shapes of the diaphragm 14, the fixed electrode 16, and the circuit board 19.

The built-in components fitted in the unit casing 12 are urged and fixed toward the bottom 12*b* of the unit casing 12 as the open end 12*a* of the unit casing 12 is bent inward. Specifically, the urging force exerted from the bent open end 12*a* to the circuit board 19 is sequentially transferred to the cylindrical electrode 18, the fixed electrode 16, the spacer 15, the diaphragm 14, and the diaphragm holder 13. Thus, the built-in components are urged toward the bottom 12*b* of the unit casing 12 and are fixed to the interior of the unit casing 12.

In the interior of the unit casing 12, an insulating air chamber 20 is provided between the external peripheral surface of the cylindrical electrode 18 and the interior peripheral surface of the unit casing 12. The insulating air chamber 20 provides insulation between the cylindrical electrode 18 and the unit casing 12.

According to the condenser microphone unit 10 of the embodiment, the cylindrical electrode 18 and the unit casing 12 are insulated by the insulating air chamber 20, thus preventing generation of a leakage current. Furthermore, eliminating an insulating washer reduces stray capacitance, thus enhancing the sensitivity and S/N ratio of the condenser microphone unit.

In the condenser microphone unit 10 shown in FIG. 1, an air chamber in the rear of the diaphragm 14 and the insulating air chamber 20 are separated. The present invention, however, is not limited to such a configuration. As shown in FIG. 2, a connecting hole 22 may be provided in the cylindrical electrode 18 to connect the air chamber in the rear of the diaphragm 14 and the insulating air chamber 20. Accordingly, the volume of the air chamber in the rear of the diaphragm 14 increases, thus facilitating vibration of the diaphragm due to a difference between pressures exerted on the front and rear surfaces of the diaphragm. This enhances the sensitivity and frequency response in bass sound of the condenser microphone unit.

<Method of Producing Condenser Microphone Unit>

A method of producing a condenser microphone unit according to the present invention is explained below with reference to FIGS. 1 to 3.

Figure 3:
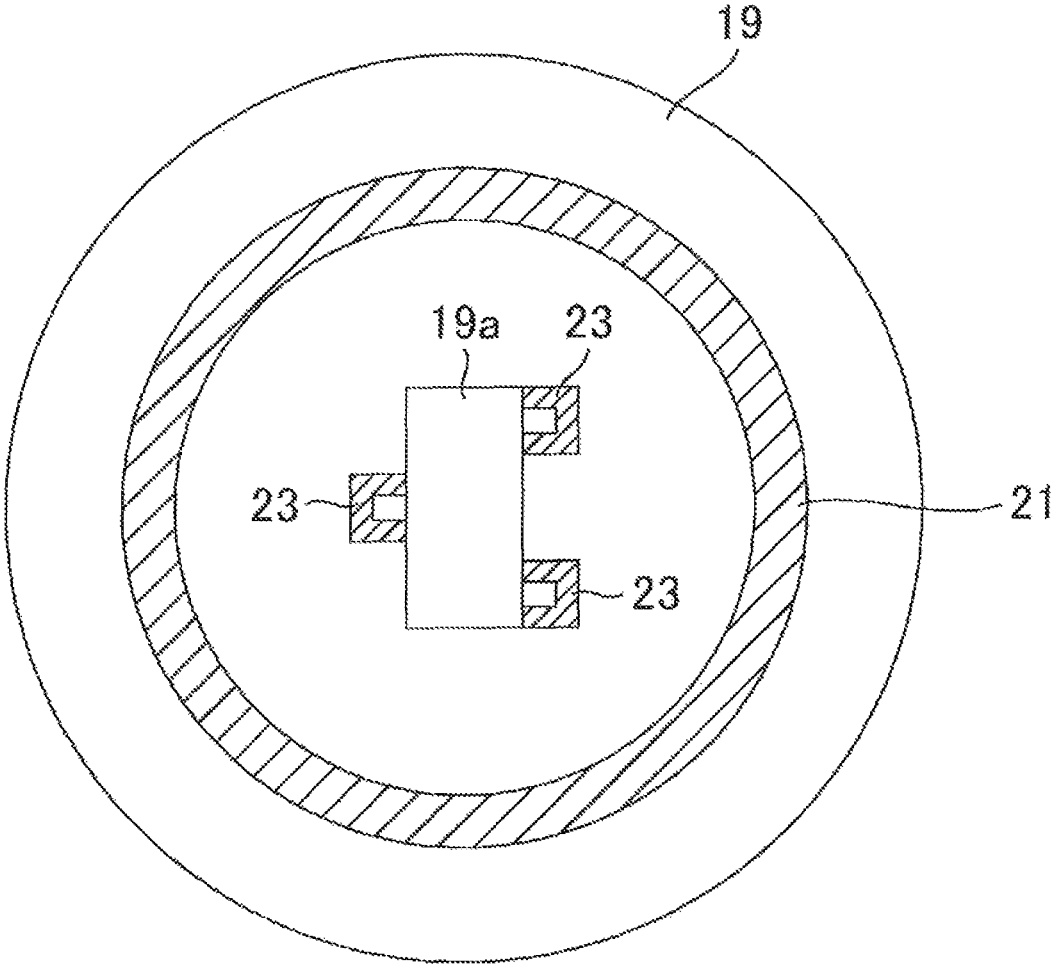
FIG. 3 is a plan view illustrating a soldering pattern applied on a circuit board in the embodiments in FIGS. 1 and 2.
Figure 4:
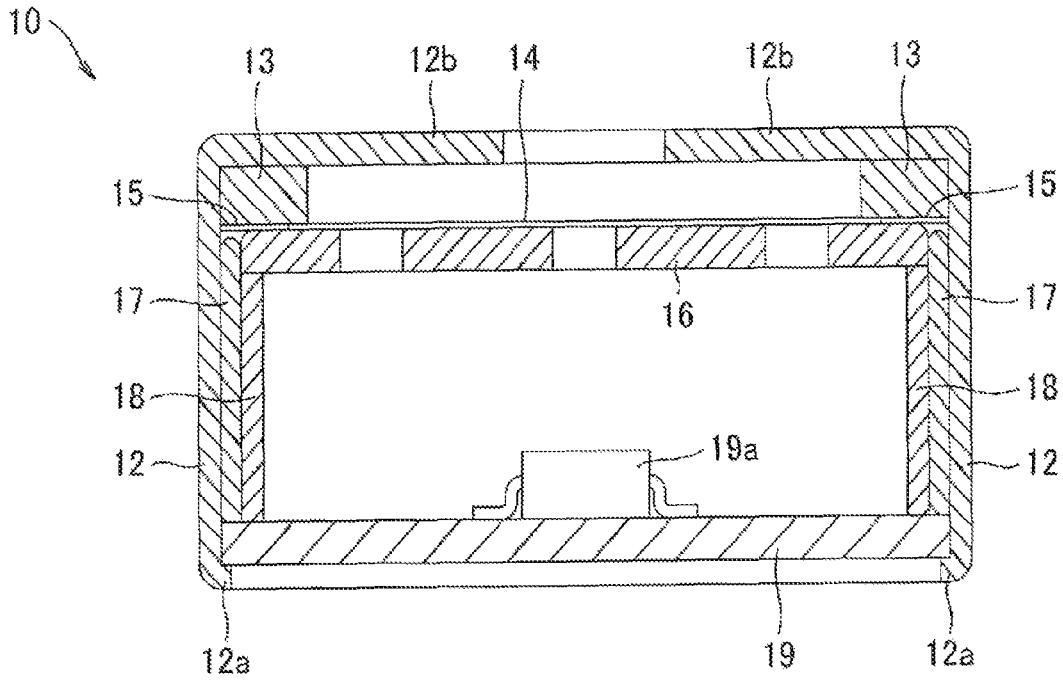
FIG. 4 is a cross-sectional view of a typical conventional condenser microphone unit.
Figure 5:
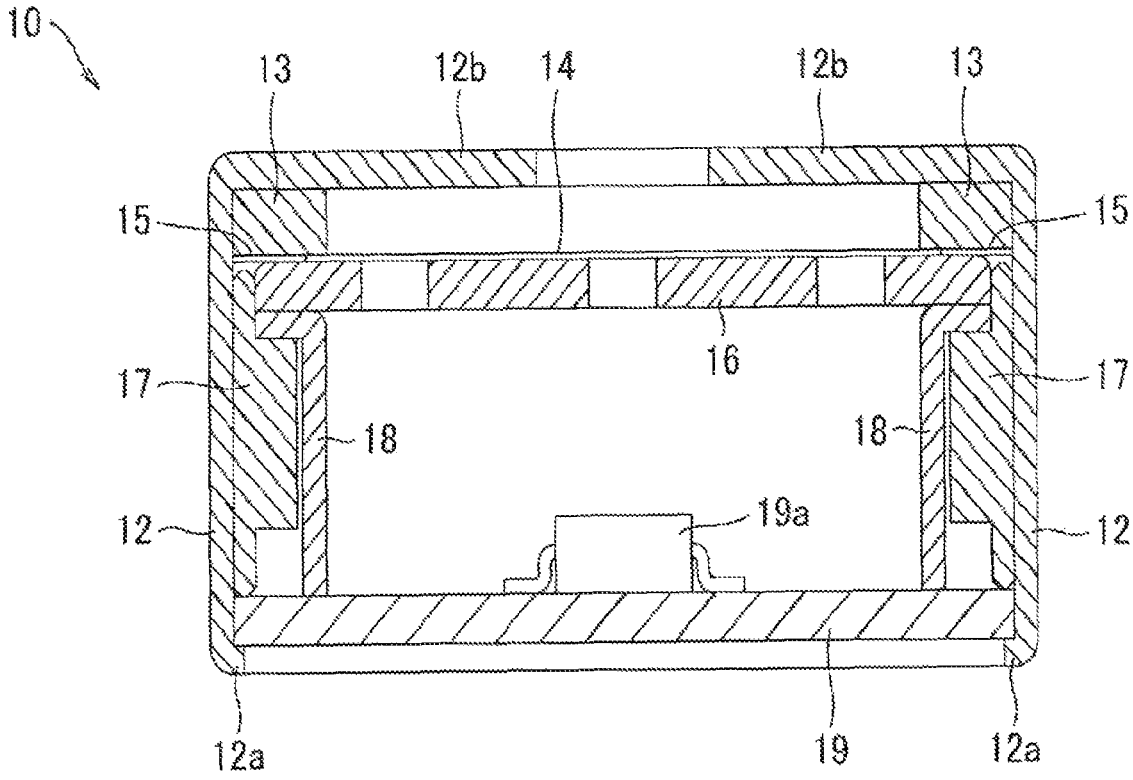
FIG. 5 is a cross-sectional view of another typical conventional condenser microphone unit.

With reference to FIG. 3, soldering patterns 23 and 21 are formed in advance, the soldering pattern 23 being provided to mount electronic components, including an FET 19*a* on a circuit board 19, the soldering pattern 21 being provided to bond a cylindrical electrode 18. Cream solder 24 is applied on the soldering pattern 21.

The electronic components and the cylindrical electrode 18 are then mounted by a chip mounter on the soldering patterns 21 and 23 of the circuit board 19 with the applied cream solder 24. In this process, the cylindrical electrode 18 is mounted such that a second end opposite to a first end provided with the step 18*a* is in contact with the circuit board 19.

Subsequently, the circuit board 19 on which the electronic components and the cylindrical electrode 18 are mounted is heated in a reflow furnace at a temperature exceeding the melting point of the cream solder 24 and not damaging the electronic components due to the heat.

A self-alignment effect is exerted on the cylindrical electrode 18 mounted on the circuit board 19 due to the surface tension of the cream solder 24, the self-alignment effect positioning the cylindrical electrode 18 following the circular soldering pattern 21. This is a phenomenon in which the surface tension of the melted cream solder 24 allows the cream solder 24 to follow the soldering pattern 21 and to be evenly distributed on the periphery of the cylindrical electrode 18, and thereby the cylindrical electrode 18 is positioned concentric to the circular soldering pattern 21.

As described above, the soldering pattern 21 is provided circularly; the cream solder 24 is applied on the pattern; and the cylindrical electrode 18 is mounted and heated. Thereby, the cylindrical electrode 18 can be positioned by the self-centering effect due to the surface tension of the cream solder 24 with no use of an insulating washer.

Subsequently, the circuit board 19 is cooled on which the cylindrical electrode 18 and the electronic components are mounted. The cream solder 24 is thus solidified, so that the cylindrical electrode 18 and the electronic components are fixed on the circuit board 19.

In the embodiment, the cylindrical electrode 18 is positioned on the circuit board 19 by the self-centering effect of the melted cream solder 24. The present invention, however, is not limited to the positioning. A jig may be used for positioning.

Then, the diaphragm holder 13, the diaphragm 14 supported thereby, the spacer 15, the fixed electrode 16, the cylindrical electrode 18, and the circuit board 19 on which the cylindrical electrode 18 and the electric components including the FET 19*a* are mounted are sequentially fitted from the open end 12*a* of the unit casing 12. In this process, the fixed electrode 16 is fitted into the step 18*a* of the cylindrical electrode 18 before being fitted into the unit casing 12 so as to be positioned relative to the cylindrical electrode 18. The circuit board 19 is fitted into the unit casing 12 in the state where the step 18*a* of the mounted cylindrical electrode 18 is directed toward the bottom 12*b* of the unit casing 12.

Thereby, the components are fitted into the unit casing 12. The diaphragm holder 13, the diaphragm 14 supported thereby, and the spacer 15 are radially positioned as being in contact with the internal peripheral surface of the unit casing 12. The circuit board 19 and the electronic components and the cylindrical electrode 18 fixed thereto are radially positioned as the circuit board 19 is in contact with the internal peripheral surface of the unit casing 12.

The open end 12*a* of the unit casing 12 in which the components above are accommodated is then bent inward so as to urge the circuit board 19 along the entire periphery. Thus, the built-in components are urged and fixed toward the bottom 12*b* of the unit casing 12, and thereby the condenser microphone unit 10 is provided. With reference to FIG. 1, the completed condenser microphone unit 10 has the diaphragm 14 supported by the diaphragm holder 13, the spacer 15, the fixed electrode 16, the cylindrical electrode 18, and the circuit board 19 on which the electric components including the FET 19*a* are mounted in the unit casing 12 in the sequence.

The insulating air chamber 20 is provided in the unit casing 12 between the external peripheral surface of the cylindrical electrode 18 and the internal peripheral surface of the unit casing 12. The insulating air chamber 20 insulates the cylindrical electrode 18 from the unit casing 12.

In the condenser microphone unit produced in the method of producing the condenser microphone unit according to the present invention, the insulating air chamber insulates the unit casing from the cylindrical electrode, thus preventing generation of a leakage current. Furthermore, eliminating an insulating washer reduces stray capacitance, thus enhancing the sensitivity, frequency response in bass sound, and S/N ratio of the condenser microphone unit.

<Condenser Microphone>

A condenser microphone can be configured by accommodating the condenser microphone unit in any one of the embodiments above into a microphone casing. According to the condenser microphone, the insulating air chamber insulates the unit casing from the cylindrical electrode, thus preventing generation of a leakage current. Furthermore, eliminating an insulating washer reduces stray capacitance, thus enhancing the sensitivity, frequency response in bass sound, and S/N ratio of the condenser microphone unit.

What is claimed is:

1. A condenser microphone unit comprising:

a diaphragm;

a fixed electrode disposed opposite to the diaphragm with a gap therebetween and defining a capacitor together with the diaphragm;

a cylindrical electrode having a first end and a second end, the first end being fitted to a periphery of the fixed electrode;

a circuit board including electronic components mounted thereon and being in contact with the second end of the cylindrical electrode, the circuit board being electrically connected to the cylindrical electrode;

a unit casing accommodating the diaphragm, the fixed electrode, the cylindrical electrode, and the circuit board; and a hollow insulating air chamber provided between an internal peripheral surface of the unit casing and an external peripheral surface of the cylindrical electrode;

wherein the cylindrical electrode has a hole that connects an air chamber in a rear of the diaphragm and the hollow insulating air chamber.

2. The condenser microphone unit according to claim 1, wherein the cylindrical electrode has a step having an increased internal diameter at the first end, and the fixed electrode is fitted to the step.

3. The condenser microphone unit according to claim 1, wherein the cylindrical electrode and the circuit board are bonded by a cream solder, and a circular soldering pattern onto which the cream solder is applied overlies the circuit board.

4. A condenser microphone comprising:

a microphone casing; and a condenser microphone unit comprising:

a diaphragm;

a fixed electrode disposed opposite to the diaphragm with a gap therebetween and defining a capacitor together with the diaphragm;

a cylindrical electrode having a first end and a second end, the first end being fitted to a periphery of the fixed electrode;

a circuit board including electronic components mounted thereon and being in contact with the second end of the cylindrical electrode, the circuit board being electrically connected to the cylindrical electrode;

a unit casing accommodating the diaphragm, the fixed electrode, the cylindrical electrode, and the circuit board; and a hollow insulating air chamber provided between an internal peripheral surface of the unit casing and an external peripheral surface of the cylindrical electrode, wherein the cylindrical electrode has a hole that connects an air chamber in a rear of the diaphragm and the hollow insulating air chamber.

* * * * *